US009835056B2

(12) United States Patent
Edel et al.

(10) Patent No.: US 9,835,056 B2
(45) Date of Patent: Dec. 5, 2017

(54) LIGNITE DRYING INTEGRATION WITH A WATER/STEAM POWER CYCLE

(71) Applicant: ALSTOM Technology Ltd, Baden (CH)

(72) Inventors: Thomas Edel, Colmar (FR); Frederic Geiger, Giromagny (FR); Thierry Pourchot, Cravanche (FR); Didier Wantz, Bavilliers (FR)

(73) Assignee: General Electric Technology GmbH, Baden (CH)

( * ) Notice: Subject to any disclaimer, the term of this patent is extended or adjusted under 35 U.S.C. 154(b) by 100 days.

(21) Appl. No.: 15/156,632

(22) Filed: May 17, 2016

(65) Prior Publication Data

US 2016/0348540 A1 Dec. 1, 2016

(30) Foreign Application Priority Data

May 26, 2015 (EP) ..... 15290140

(51) Int. Cl.

| | |
|---|---|
| ***F01K 7/44*** | (2006.01) |
| ***F01K 7/38*** | (2006.01) |
| ***F01K 7/16*** | (2006.01) |
| ***F01K 7/22*** | (2006.01) |
| ***F01K 7/40*** | (2006.01) |
| ***F01K 17/06*** | (2006.01) |

(52) U.S. Cl.

CPC ..... *F01K 7/44* (2013.01); *F01K 7/16* (2013.01); *F01K 7/22* (2013.01); *F01K 7/38* (2013.01); *F01K 7/40* (2013.01); *F01K 17/06* (2013.01)

(58) Field of Classification Search

CPC ..... F01K 7/44; F01K 7/16; F01K 7/38; F01K 17/06; F01K 7/40; F01K 7/22

USPC ..... 60/653, 654, 677–680

See application file for complete search history.

(56) References Cited

U.S. PATENT DOCUMENTS

| | | | | |
|---|---|---|---|---|
| 2,653,447 | A * | 9/1953 | Heller | F01K 23/103 122/480 |
| 4,291,539 | A | 9/1981 | Potter | |
| 4,601,113 | A | 7/1986 | Draper et al. | |
| 4,601,115 | A | 7/1986 | Draper et al. | |
| 5,353,517 | A | 10/1994 | Weiss | |
| 6,148,599 | A | 11/2000 | McIntosh et al. | |
| 8,091,361 | B1 * | 1/2012 | Lang | F01K 3/002 60/653 |

(Continued)

FOREIGN PATENT DOCUMENTS

| | | | |
|---|---|---|---|
| AU | 1404783 | A | 8/1983 |
| CN | 101881191 | A | 11/2010 |

(Continued)

OTHER PUBLICATIONS

Edel et al., U.S. Appl. No. 15/162,904, filed May 24, 2016.

(Continued)

*Primary Examiner* — Hoang Nguyen
(74) *Attorney, Agent, or Firm* — GE Global Patent Operation; Cynthia W. Flanigan

(57) ABSTRACT

The invention relates to power plant with a steam water power cycle and a lignite dryer that uses steam from the steam water power cycle. The connection of the lignite dryer to the steam water power cycle includes a first extraction line and a second extraction line.

7 Claims, 1 Drawing Sheet

(56) References Cited

U.S. PATENT DOCUMENTS

| | | | | |
|---|---|---|---|---|
| 8,661,821 | B2 * | 3/2014 | Zhao | F01K 7/22 122/4 R |
| 2010/0212320 | A1 | 8/2010 | Block et al. | |
| 2010/0282082 | A1 * | 11/2010 | Butler | B01D 53/343 95/227 |
| 2011/0094228 | A1 * | 4/2011 | Fan | F01K 7/22 60/679 |
| 2011/0214427 | A1 | 9/2011 | Zhao et al. | |
| 2012/0055158 | A1 | 3/2012 | Berger et al. | |

FOREIGN PATENT DOCUMENTS

| | | | |
|---|---|---|---|
| CN | 201697441 | U | 1/2011 |
| CN | 102353237 | A | 2/2012 |
| CN | 103453752 | A | 12/2013 |
| CN | 102759259 | B | 6/2014 |
| CN | 102758657 | B | 12/2014 |
| CN | 204041130 | U | 12/2014 |
| DE | 41 15 781 | C2 | 9/1994 |
| DE | 19612186 | A1 | 10/1997 |
| DE | 195 18 644 | C2 | 4/1998 |
| DE | 195 12 015 | C2 | 7/1998 |
| DE | 196 01 931 | C2 | 9/2000 |
| DE | 103 19 477 | A1 | 11/2004 |
| DE | 10 2007 023 336 | A1 | 11/2008 |
| DE | 10 2009 019 334 | A1 | 11/2010 |
| DE | 102009035062 | A1 | 2/2011 |
| EP | 0 576 053 | B1 | 1/1996 |
| EP | 2 423 465 | A2 | 2/2012 |
| EP | 2412943 | A2 | 2/2012 |
| EP | 2 436 978 | A1 | 4/2012 |
| EP | 2 873 934 | A1 | 5/2015 |
| FR | 485639 | A | 1/1918 |
| FR | 2984400 | A1 | 6/2013 |
| JP | H06-146812 | A | 5/1994 |
| WO | 2011/033559 | A1 | 3/2011 |
| WO | 2012/005164 | A1 | 1/2012 |

OTHER PUBLICATIONS

Edel et al., U.S. Appl. No. 15/163,159, filed May 24, 2016.

Edel et al., U.S. Appl. No. 15/162,987, filed May 24, 2016.

Rupprecht, T., and Fielenbach, C., "Efficiency and Flexibility—Techno-Economical Challenges for Pre-Dried Lignite Fired Power Plants," Power-Gen Europe, Milan, Italy, pp. 1-19 (Jun. 7-9, 2011).

Extended European Search Report and Opinion issued in connection with related EP Application No. 15290138.5 dated Aug. 13, 2015.

Extended European Search Report and Opinion issued in connection with related EP Application No. 15290139.3 dated Nov. 18, 2015.

Extended European Search Report and Opinion issued in connection with related EP Application No. 15290141.9 dated Dec. 2, 2015.

Extended European Search Report and Opinion issued in connection with related EP Application No. 16169541.6 dated Jun. 21, 2016.

Extended European Search Report and Opinion issued in connection with related EP Application No. 16169295.9 dated Nov. 21, 2016.

* cited by examiner

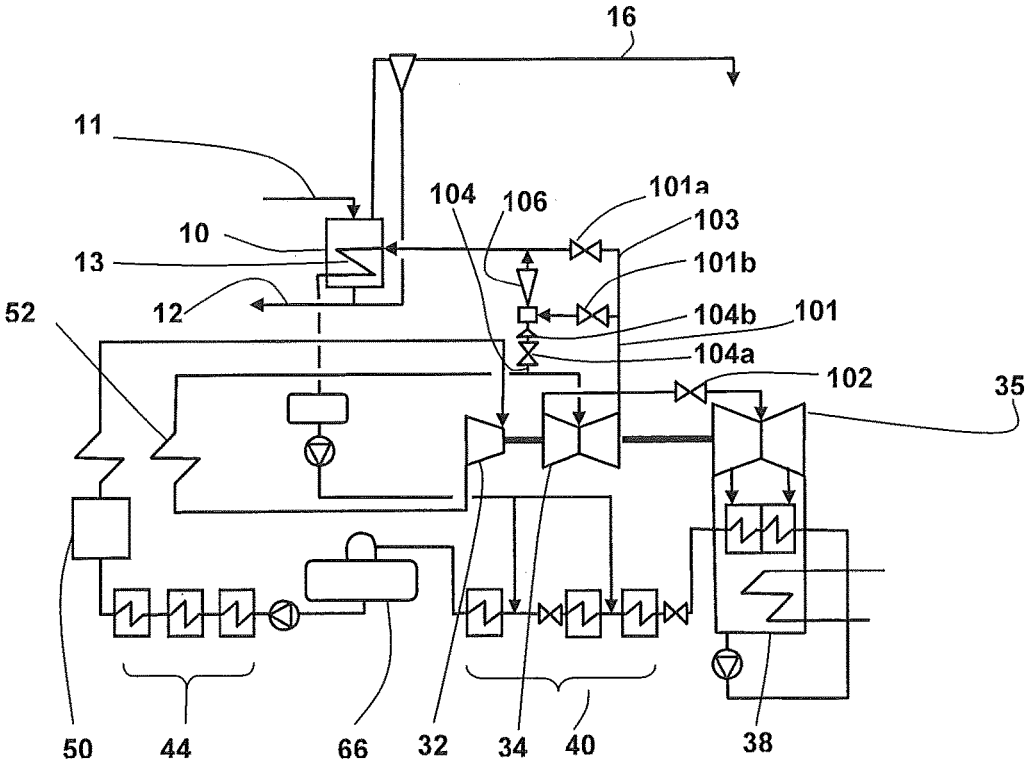
16
11
10
13
12
52
104
106
101a
103
101b
104b
101
104a
102
35
50
44
66
32
34
40
38

LIGNITE DRYING INTEGRATION WITH A WATER/STEAM POWER CYCLE

CROSS-REFERENCE TO RELATED APPLICATIONS

This application claims priority to European Patent Application No. 15290140.1 filed May 26, 2015, the contents of which are hereby incorporated in its entirety.

TECHNICAL FIELD

The present disclosure relates to integrate lignite drying processes to improve both efficiency and cost-of-power generation of a dry-lignite coal power plant applicable with or without CO2 capture. The disclosure further relates to arrangements for using direct steam extraction from water/steam power cycle as an energy source for lignite coal drying.

BACKGROUND INFORMATION

General principle of Lignite Drying in a lignite fired plant is well known, using either hot flue gas extraction or steam extraction from Water & Steam cycle or both to supply the lignite drying system that includes beater mills, rotary drum dryers and/or fluidized bed dryer.

Lignite drying techniques have been developed and tested in order to use medium or low enthalpy heat to achieve partial or high level of lignite pre-drying before pulverization, and gain typically up to 3% point efficiency gains without heat recovery of evaporation vapour of lignite moisture or 5% point efficiency gains with heat recovery of evaporation vapour of lignite moisture. The heat is either originating from low pressure steam extraction, or from exhaust flue gas. These techniques sometime additionally use mechanical or chemical dewatering processes.

U.S. Pat. No. 8,661,821 B2 in which superheated steam, which has done partial work in a steam turbine, is extracted from a water/stem power cycle and used as a drying medium to evaporate moisture from coal powder. Condensate from the drying is then fed into a deaerator of the steam turbine via a condensate pump for recirculation. As discussed, the drying steam can be extracted from any number of steam extraction points contained in the water/steam power cycle.

SUMMARY

A power plant is disclosed that is intended to provide an alternative means of thermally integrating a lignite dryer into a water/steam cycle of the power plant using steam extraction.

It attempts to address this problem by means of the subject matters of the independent claims. Advantageous embodiments are given in the dependent claim.

An aspect includes power plant with a water/steam power cycle, lignite dryer. The water/steam cycle comprises a pressure series of steam turbines including a high pressure steam turbine, an intermediate pressure steam turbine, and a low pressure steam turbine. The cycle further includes a re-heater that is fluidly located between the high pressure steam turbine and the intermediate pressure steam turbine.

The lignite dryer includes a heater connected to a steam portion of the steam/water power cycle so as to enable utilisation of steam energy in the lignite dryer (10).

The connection to the steam portion of the steam water power cycle comprises a first extraction line that is fluidly connected to the water/steam power cycle between the re-heater and the intermediate pressure steam turbine, or alternatively between the high pressure turbine and the re-heater and to the heater. The first extraction line further includes an ejector. The connection further includes a second extraction line that is fluidly connected to the water/steam power cycle between the intermediate pressure steam turbine (34) and the low pressure steam turbine (35).

The configuration and location of the ejector and the connection of the second extraction line to the ejector enables a lower pressure steam in the second extraction line to be fed into the heater together with a higher pressure steam in the first extraction line.

In an aspect the second extraction line includes a bypass that fluidly connects the first extraction line to the second extraction line so as to bypass the ejector.

In further aspect the power plant includes a de-superheater in the first extraction line upstream of the ejector.

In further aspect the power plant includes a throttle valve fluidly located between the connection of the second extraction line to the water/steam power cycle and the low pressure steam turbine.

Another aspect includes a method of controlling a power plant with lignite dryer. The method includes the steps of providing a water/steam power cycle having a pressure series of steam turbines including a high pressure steam turbine, an intermediate pressure steam turbine, and a low pressure steam turbine. The water/steam power cycle further includes a re-heater fluidly between the high pressure steam turbine and the intermediate pressure steam turbine and a throttle valve fluidly between the intermediate pressure steam turbine and the low pressure steam turbine.

The method further includes providing a lignite dryer having a heater fluidly connected to a steam portion of the steam/water power cycle so as to utilise steam energy in the lignite dryer, wherein the connection to the steam portion of the steam water power cycle comprises a first extraction line, connected to the water/steam power cycle between the re-heater and the intermediate pressure steam turbine or alternatively between the high pressure turbine and the re-heater, to the heater, including an ejector and further comprises a second extraction line that is fluidly connected to the water/steam power cycle between the intermediate pressure steam turbine and the throttle valve, the second extraction line including a bypass, with a bypass valve.

The method includes the further step of controlling a flow-rate to the heater by adjusting a pressure in the second extraction line in conjunction with the bypass valve.

In a further aspect the method includes providing a first control valve in the first extraction line upstream of the ejector and a second control valve in the second extraction line upstream of the ejector and then controlling the flow-rate to the heater in further conjunction with the first control valve and the second control valve.

Other aspects and advantages of the present disclosure will become apparent from the following description, taken in connection with the accompanying drawings which by way of example illustrate exemplary embodiments.

BRIEF DESCRIPTION OF THE DRAWINGS

By way of example, an embodiment of the present disclosure is described more fully hereinafter with reference to the accompanying drawings, in which:

FIG. 1 is a schematic of a lignite fired power plant according to an exemplary embodiment of the disclosure.

DETAILED DESCRIPTION

Exemplary embodiments of the present disclosure are now described with references to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiment disclosed herein.

FIG. 1 shows an exemplary embodiment of a power plant with a drying system to dry pulverised lignite.

The drying includes an inlet line 11 for directing lignite in the lignite dryer 10, a vapour outlet line 16 for exhausting moisture laden gas from the lignite dryer and a solids outlet line 12 for discharging dried lignite for use in a combustor. The lignite dryer 10 can be a Steam Fluidized Bed Dryer or a Steam Heated Rotary Tube Dryer.

In an exemplary embodiment shown in FIG. 1, the power plant includes a water/steam cycle a water/steam power cycle having a pressure series of steam turbines 32,34,35, a condenser 38 at a low pressure end of pressure series of steam turbines 32, 34,35 configured and arrange to condense steam exhausted from the low pressure end of the pressure series of steam turbines, a low pressure condensate system 40 arrangement downstream of the condenser 38, adapted to preheat condensate from the condenser 38, a high pressure condensate system 44 separated from the low pressure condensate system 40 by a feed water tank 66, and boiler 50 for boiling and superheating condensate from the high pressure condensate system 44 and to further and optionally performs the function of a re-heater 52 for reheating steam between the pressure series steam turbines 32,34,35.

In an exemplary embodiment shown in FIG. 1, a first extraction line 104 extends from a point in the water/steam power cycle between the re-heater 52 and the intermediate pressure steam turbine to the heater 13 of the lignite dryer 10. This enables extraction steam to be used as an energy source for the lignite dryer 10. In an exemplary embodiment the first extraction line 104 includes a de-superheater.

In an exemplary embodiment, shown in FIG. 1, includes an additional extraction line 101 with an ejector 106. This additional extraction line 101 extends from a point of the water/steam cycle located between the intermediate pressure steam turbine 34 and the low pressure steam turbine 35 to the first extraction line 104 at the ejector 106.

The ejector 106 is a device that operates using the venturi principle. The device utilises higher pressure steam from the first extraction line 104 to generate a high-velocity jet at the throat of a convergent-divergent nozzle thus creating a low pressure at that point. The low pressure point, which is the point at which additional extraction line 101 connects to the first extraction line 104, draws extraction steam from the lower pressure additional extraction line. In this way lower pressure steam in the second extraction line can be fed into the heater together with higher pressure steam of the first extraction line 104.

In an exemplary embodiment shown in FIG. 1 the first extraction line 104 includes a de-superheater 104*b*. In an exemplary embodiment where the first extraction line 104 includes an ejector 106, the de-superheater 104*b* is located upstream of the ejector 106.

In an exemplary embodiment shown in FIG. 1 in which the first extraction line 104 includes an ejector 106, the additional extraction line 101 includes a bypass 103 with a bypass valve 101*a*, connecting the first extraction line 104 to the second extraction line 101 so as to bypass the ejector 106. This arrangement can be used when the steam plant is operating a high or maximum load such that the steam pressure in the additional extraction line 101 has sufficient pressure and energy to supply the lignite dryer 10 while maximising energy recovery in the intermediate pressure steam turbine 34 by minimising extractions from this turbine.

In further exemplary embodiments shown in FIG. 1, a throttle valve 102 is located in the water/steam power cycle between the connection of the second extraction line 101 and the low pressure steam turbine so as to enable control extraction pressure in the additional extraction line 101. This can be achieved by coordinated operation of the throttle valve 102 with the bypass valve 101*a*. For example at full and very high loads throttle valve 102 is fully opened while the bypass valve 101*a* is used to control supply pressure at adequate level. As load decreases, resulting in a lower low pressure steam turbine 35 pressure, the bypass valve 101*a* is opened further until in the fully opened position. At this point, or else at a pre-set opening point, the throttle valve 102 begins to close thus maintain the required intermediate pressure steam turbine 34 exit pressure at level required to supply steam to the lignite dryer 10. The operation limit of the additional extraction with this arrangement, without use of the first extraction may be limited by the maximum low pressure steam turbine 35 steam temperature limit. As a result, this solution is most applicable for high loads, for example above 70%, as low pressure steam turbine 35 temperature limitations typically limit throttling at lower load.

In an exemplary embodiment where temperature limitations of the low pressure steam turbine 35 are reached, the bypass valve 101*a* is closed while steam in the additional extraction line 101 is mixed with hot reheat extraction steam from the first extraction 104 using the ejector 106. This arrangement may be used for middle and low water/steam power cycle loads down, for example, 35% or even lower, depending on the design limits of the water/steam power cycle components. The control of the exemplary embodiment may be further enhance by providing a first control valve 104*a* in the first extraction line 104 upstream of the ejector 106 and a second control valve 101*b* in the second extraction line 101 upstream of the ejector 106. In this arrangement the flow-rate to the heater is further controlled in further conjunction with the first control valve 104*a* and the second control valve 101*b*.

Although the disclosure has been herein shown and described in what is conceived to be the most practical exemplary embodiment, the present disclosure can be embodied in other specific forms. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

The invention claimed is:

1. A power plant comprising:

a water/steam power cycle comprising:

a pressure series of steam turbines including:

a high pressure steam turbine;

an intermediate pressure steam turbine;

a low pressure steam turbine;

a re-heater fluidly located between the high pressure steam turbine and the intermediate pressure steam turbine; and a lignite dryer having:

a heater connected to a steam portion of the steam/water power cycle so as enable utilisation of steam energy in the lignite dryer, wherein the connection to the steam portion of the steam water power cycle comprises:

a first extraction line, fluidly connected to the water/steam power cycle between the high pressure turbine and the intermediate pressure steam turbine, the first extraction line further including an ejector;

a second extraction line, fluidly connected to the water/steam power cycle between the intermediate pressure steam turbine and the low pressure steam turbine, wherein the configuration and location of the ejector and the connection of the second extraction line to the ejector enables a lower pressure steam in the second extraction line to be fed into the heater together with a higher pressure steam of the first extraction line.

2. The power plant of claim 1 wherein the second extraction line includes a bypass fluidly connecting the first extraction line to the second extraction line so as to bypass the ejector.

3. The power plant of claim 1 further comprises a desuperheater in the first extraction line upstream of the ejector.

4. The power plant according to claim 1 further comprising a throttle valve fluidly between the connection of the second extraction line to the water/steam power cycle and the low pressure steam turbine.

5. The power plant of claim 1, wherein the first extraction line is connected to the water/steam power cycle between the re-heater and the intermediate pressure steam turbine.

6. A method of controlling a power plant, comprising the steps of:

providing a water/steam power cycle comprising:

a pressure series of steam turbines including:

a high pressure steam turbine;

an intermediate pressure steam turbine; and a low pressure steam turbine;

a re-heater fluidly between the high pressure steam turbine and the intermediate pressure steam turbine;

a throttle valve fluidly between the intermediate pressure steam turbine and the low pressure steam turbine; and providing a lignite dryer having:

a heater fluidly connected to a steam portion of the steam/water power cycle so as to utilise steam energy in the lignite dryer, wherein the connection to the steam portion of the steam water power cycle comprises:

a first extraction line, connected to the water/steam power cycle between the high pressure turbine and the intermediate pressure steam turbine to the heater, including an ejector; and a second extraction line, fluidly connected to the water/steam power cycle between the intermediate pressure steam turbine and the throttle valve, and to the ejector, the second extraction line further including a bypass, with a bypass valve, to enable bypassing of the ejector; and controlling a flow-rate to the heater by adjusting a pressure in the second extraction line in conjunction with the bypass valve.

7. The method of claim 6 including the further steps of:

providing a first control valve in the first extraction line upstream of the ejector;

providing a second control valve in the second extraction line upstream of the ejector; and controlling the flow-rate to the heater in further conjunction with the first control valve and the second control valve.

* * * * *